US005183230A

United States Patent [19]

Walker et al.

[11] Patent Number: 5,183,230

[45] Date of Patent: Feb. 2, 1993

[54] COMPUTER KEYBOARD SUPPORT WITH PADDED WRIST SUPPORT

[75] Inventors: Wayne E. Walker, Kent; Grant A. Walker, Federal Way, both of Wash.

[73] Assignee: Fox Bay Industries, Inc., Kent, Wash.

[21] Appl. No.: 824,912

[22] Filed: Jan. 21, 1992

Related U.S. Application Data

[63] Continuation of Ser. No. 626,217, Dec. 12, 1990, abandoned.

[51] Int. Cl.[5] ..... B43L 15/00

[52] U.S. Cl. ..... 248/118; 248/118.3; 248/346

[58] Field of Search ..... 248/118, 118.1, 118.3, 248/633, 918, 346; 108/27

[56] References Cited

U.S. PATENT DOCUMENTS

| | | | |
|---|---|---|---|
| Re. 33,556 | 3/1991 | Berke | 248/118 X |
| 1,277,169 | 8/1918 | Anderson | 248/118.3 |
| 1,801,669 | 4/1931 | Hintz et al. | 400/715 |
| 2,193,414 | 3/1940 | Berkman | 108/63 |
| 2,950,890 | 8/1960 | Hough, Jr. | 248/118 |
| 3,300,250 | 1/1967 | Dollgener et al. | 248/118 X |
| 3,362,666 | 1/1968 | O'Donnell | 248/633 |
| 4,313,112 | 1/1982 | Foster | 340/700 |
| 4,481,556 | 11/1984 | Berke et al. | 248/118 X |
| 4,482,063 | 11/1984 | Berke et al. | 248/118 X |
| 4,482,064 | 11/1984 | Berke et al. | 248/118 X |
| 4,511,111 | 4/1985 | Godfrey et al. | 248/346 X |
| 4,545,554 | 10/1985 | Latino | 248/118.1 |
| 4,570,803 | 2/1986 | Peterson | 248/118 X |
| 4,621,781 | 11/1986 | Springer | 248/118 |
| 4,779,922 | 10/1988 | Cooper | 248/918 X |
| 4,913,390 | 4/1990 | Berke | 248/118.3 X |

FOREIGN PATENT DOCUMENTS

| | | | |
|---|---|---|---|
| 751828 | 1/1967 | Canada . | |
| 1010487 | 5/1977 | Canada . | |
| 0003872 | 12/1900 | Fed. Rep. of Germany | 248/118.3 |
| 1913287 | 3/1969 | Fed. Rep. of Germany . | |
| 2203265 | 8/1973 | Fed. Rep. of Germany . | |
| 2836655 | 10/1979 | Fed. Rep. of Germany . | |
| 2910855 | 10/1980 | Fed. Rep. of Germany . | |
| 1026026 | 4/1953 | France | 248/633 |
| 23550 | 11/1977 | Sweden . | |
| 22065 | 2/1978 | Sweden . | |
| 23342 | 11/1978 | Sweden . | |

OTHER PUBLICATIONS

The one-page brochure entitled "Stockholms Dataprodukter AB", dated Apr. 8, 1980, labelled Exhibit A. Four photographs of a product by Fox Bay Industries.

*Primary Examiner*—David L. Talbott
*Assistant Examiner*—Derek J. Berger
*Attorney, Agent, or Firm*—Merchant, Gould, Smith, Edell, Welter & Schmidt

[57] ABSTRACT

A keyboard support is provided for use with computer keyboards. The keyboard support includes a foam covered baseplate that securely positions and cushions the keyboard. A wrist support is attached to the baseplate along the front edge of the baseplate. The wrist support includes a neoprene foam core covered by a friction resistive fabric. The padded feature of the wrist support cushions the operator's wrists which can help in preventing Carpal Tunnel Syndrome (CTS). A first version of the keyboard support includes a wrist support of a fixed height to positoin the wrists at a level and horizontal plane when the fingers are positioned over the keys of the keyboard. The level positioning of the wrists is also important in preventing CTS. A second version of the keyboard support includes a vertically adjustable wrist support which may be adjusted in height to adapt the support to any sized keyboard. The second version also includes an overhang that positively positions the support at the edge of a table or desktop surface.

13 Claims, 3 Drawing Sheets

COMPUTER KEYBOARD SUPPORT WITH PADDED WRIST SUPPORT

This is a continuation, of application Ser. No. 07/626,217, filed Dec. 12, 1990, which was abandoned upon the filing hereof.

BACKGROUND OF THE INVENTION

The present invention relates to a support for a keyboard of a computer or computer terminal. These type of supports generally include a support for the body of the keyboard and a connected support for a user's hands, wrists and/or forearms. Recently, much attention has been given to the phenomenon of Carpal Tunnel Syndrome (CTS), a form of tendinitis within the arms and wrists of a user of computer equipment. When a person's job requires them to be at a computer keyboard for an extended period of time, stress can build up within a person's forearms and cause CTS. This condition is quite painful and can be debilitating to the point of causing a significant loss of time at work or a permanent disability from working at keyboards, ever again. The field of keyboard supports have, to date, attempted to address the problems associated with Carpal Tunnel Syndrome.

There are a number of patents within the field of computer keyboard supports. U.S. Pat. No. 4,482,063 to Berke et al. shows several different types of keyboard supports that generally comprise a flat keyboard support with a rigid wrist support connected to the front of the keyboard support. The main drawbacks to the various keyboard supports shown within Berke et al. is that the wrist support is rigidly spaced at a set distance relative to the keyboard and the wrist support is constructed of the same hard plastic of the keyboard support offering little comfort to the wrists and forearms.

U.S. Pat. No. 4,621,781 to Springer shows a complex computer desk station that includes expensive keyboard and wrist supports that are attached to the desk. Springer's wrist support is of a foam pad nature, but the keyboard and wrist supports have several disadvantages in practical use. First, the wrist support is of an irregular configuration and includes a central divider between a user's arms. Many users would find this divider awkward to use. Second, the wrist support is adjustable by pivoting the support at an angle relative to the keyboard. Contrary to Springer's assertions, the most comfortable position of a user's wrists relative to the keyboard is on an even and horizontal plane relative to the keyboard, not at an angle as used in Springer's support. Third, the complicated connections between the keyboard support, wrist support and desk make the support impractical in any application except for the specialized desk that is shown within Springer.

German patent No. 1,913,287 to Stegemann shows a typewriter support and attached wrist support of simpler construction than the support of Springer. The wrist support is adjustable horizontally and vertically relative to the keyboard of the typewriter. However, there are two drawbacks to Stegemann's support. First, the wrist support is constructed of a single hard material that does not assist in cushioning a user's wrists in any manner. Second, the wrist support is free to pivot relative to the keyboard or typewriter support which can cause a user to position his or her wrists at an angle to the keyboard with the intendant harmful effects.

The two primary problems of keyboard supports is that they do not hold the wrists and forearms in a neutral and non-flexed condition relative to the keyboard, and most of the supports fail to provide a cushioned surface for the wrists or forearms. If a keyboard operator uses the Stegemann or Springer supports, the wrists are allowed to be disposed at an angle relative to the keyboard. The angled position is not a neutral position and will inherently develop irritation within the forearm. For proof of this, one need only look at the results of using conventional keyboards without a special support on a flat desktop. In this position, the forearms may rest upon the flat surface of the desk, but the wrists are cocked at an angle relative to the desktop in order to reach the keys of the keyboard. When using the Stegemann or Springer supports or no support, a keyboard operator will continue to use the keyboard in a flexed position. Alternatively, the operator may lift/her arms off of the support or desktop to lie horizontal to the keyboard. However, in achieving this horizontal position, the operator's forearms will become exhausted over a long period of time from holding his/her wrists in a non-supportive manner over the keyboard. Thus, it can be seen that the prior art keyboard supports have generally failed to address all of the issues associated with the safe use of keyboards over an extended period of time.

SUMMARY OF THE INVENTION

It is an object of this invention to provide a keyboard support with means for cushioning and positioning an operator's wrists in a horizontal manner relative to the keyboard.

Another object of the invention is to provide a keyboard support that does not allow the operator's wrists to bend at an angle relative to the keyboard.

It is a further object of the invention to provide a keyboard support that is cost effective in design and manufacture, and may be able to be adapted for a broad variety of keyboards and desktops.

Other objects of the invention will be apparent hereinafter from the specification and from the recital of the appended claims, particularly when read in conjunction with the accompanying drawings.

The present invention comprises a computer keyboard support that supports any conventional keyboard upon a desk or table surface. The support includes a first flat portion that rests upon the flat surface of the desk. The keyboard rests upon the first flat portion which includes an anti-slip surface that prevents the keyboard from inadvertently sliding upon the support. The keyboard support further comprises a second wrist support portion attached along the front edge of the first flat portion. The wrist support portion includes a padded support for an operator's wrists when using the keyboard. The wrist support portion holds the operator's wrists on a horizontal plane with most conventional keyboards. The horizontal position of the wrists relative to the keyboard defines a neutral position for most people that minimizes the stress and repetitive strain from using the keyboard over prolonged periods of time. A second embodiment of the computer keyboard support of the present invention includes an overhang portion that is positioned over the edge of the desktop. The overhang portion provides a support for the wrist support portion which is vertically adjustable along the depth of the overhang. The adjustable feature of this second embodiment allows the keyboard support of the present invention to be customized to any sized keyboard and the anatomy of any keyboard operator.

DETAILED DESCRIPTION OF THE INVENTION

The widespread use of computers in the workplace has brought about many repetitive strain injuries to computer keyboard operators. Wrist and forearm injuries, in particular, have been noted in many cases and have been grouped together under the classification of Carpal Tunnel Syndrome (CTS).

The wrist joint is formed of eight small carpal bones. The transverse carpal ligament stretches across the underside of the wrist, and this forms the bottom of the carpal tunnel. The median nerve passes through the tunnel, along with a sheath containing tendons that go to the fingers. Prolonged work at a keyboard causes repetitive strain to develop through the fingers that transfers to the hand, wrist and forearm. When both the wrist and fingers are flexed, the transfer of stain can be more pronounced. The wrist is usually flexed or bent at an angle when operating a keyboard without a wrist support. The flexure of the wrist while typing with individual fingers causes swelling of the tendon sheath or narrowing of the carpal tunnel.

If the typing is not continued over a long period of time, the swelling will go down naturally and the tendon sheath will return to its normal open diameter. However, for many keyboard operators, their jobs require that they type at keyboards all day long, and day after day. This prolonged typing action can cause a further swelling of the tendon sheath and subsequent narrowing of the carpal tunnel. Symptoms of Carpal Tunnel Syndrome include a tingling or numbness of the hand, pain in the hand radiating up the arm, reduced ability within the hand, and atrophy of the muscle at the base of the thumb. Treatment of CTS can range from resting of the hands and arms for a period of rehabilitation time to surgery to enlarge the tunnel by cutting the transverse carpal ligament.

It has been found that CTS can be prevented or slowed down by supporting the wrist and forearm in a horizontal plane relative to the keyboard. This position can be described as a stress-neutral position where the repetitive strain of the movement of the fingers is not transferred through the wrist and forearm because the wrist is in a non-flexed resting position. Several other important factors in reducing the risk of CTS involves keeping the wrist and forearm in a stationary position while preventing the compression of the wrist and forearm against a hard surface such as a desktop or rigid support.

Figure 1:
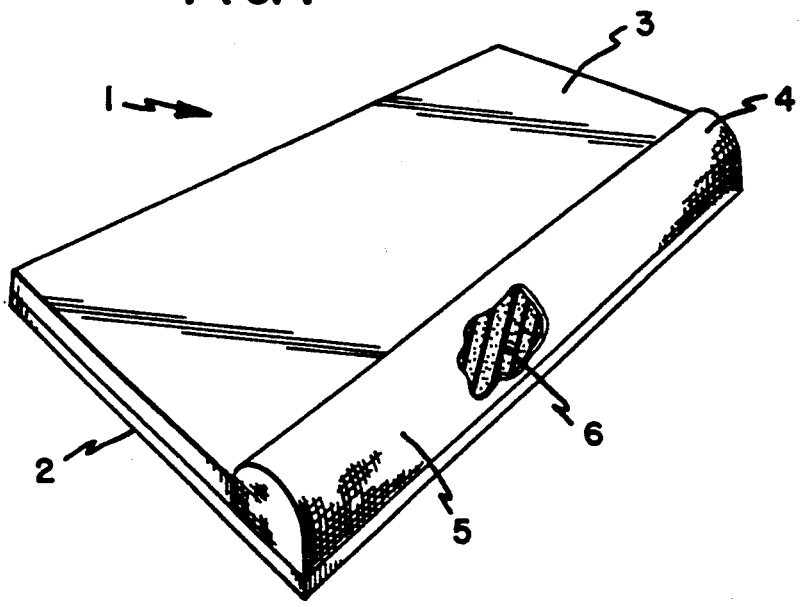
FIG. 1 shows a partially cut away perspective view of the first embodiment of the present invention.
Figure 2:
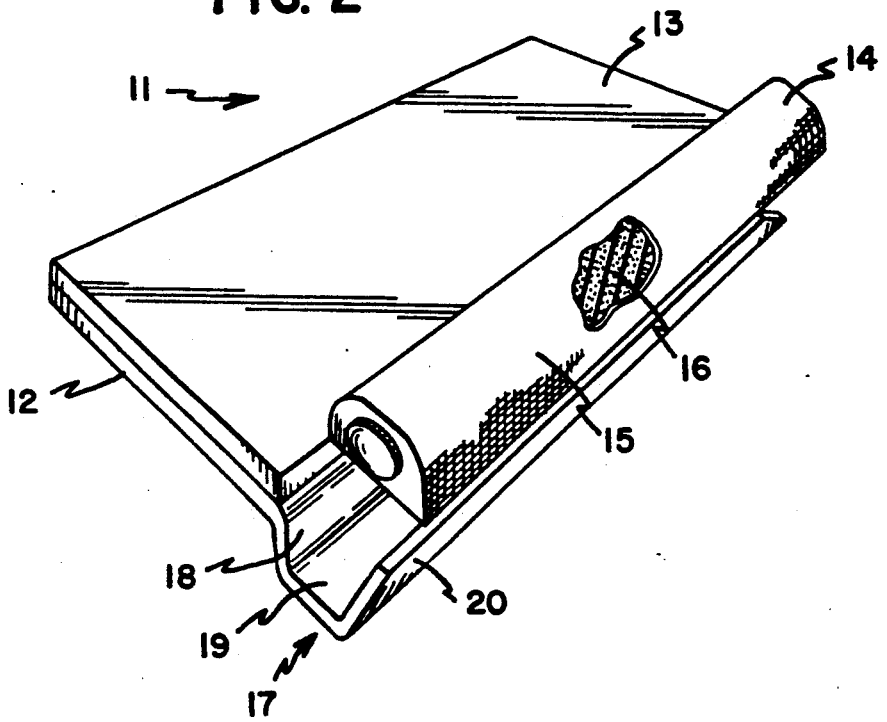
FIG. 2 shows a partially cut away perspective view of the second embodiment of the present invention.

Prior art keyboard supports have generally failed to address all of the issues associated with the prevention of CTS. FIGS. 1 and 2 show the preferred embodiments of the keyboard support of the present invention which correct many of the deficiencies of the prior art supports, and achieve many of the goals associated with reducing or preventing of Carpal Tunnel Syndrome.

FIG. 1 shows a keyboard support 1 that includes a baseplate 2 forming a first keyboard support portion. The keyboard support portion includes a non-skid foam pad 3 upon which a conventional computer keyboard may rest without slipping relative to the keyboard support. The pad also cushions the keyboard. A second wrist support portion 4 lies across the width and along one edge of the keyboard support. The wrist support portion 4 includes a fabric cover 5 that covers a neoprene foam blend core. The foam core gives the wrist support a padded feature to allow an operators wrists to be comfortably supported and eliminates pressure points along the operator's wrists that would otherwise develop if the wrists are compressed against a hard surface. The wrist support is of a predetermined height above the pad 3 such that the operator's wrists lie horizontal relative to the keyboard with the hands positioned above the keys of the keyboard. The wrist support also includes rounded corners to prevent any hard edges from digging into an operator's wrists or hands.

Figure 3:
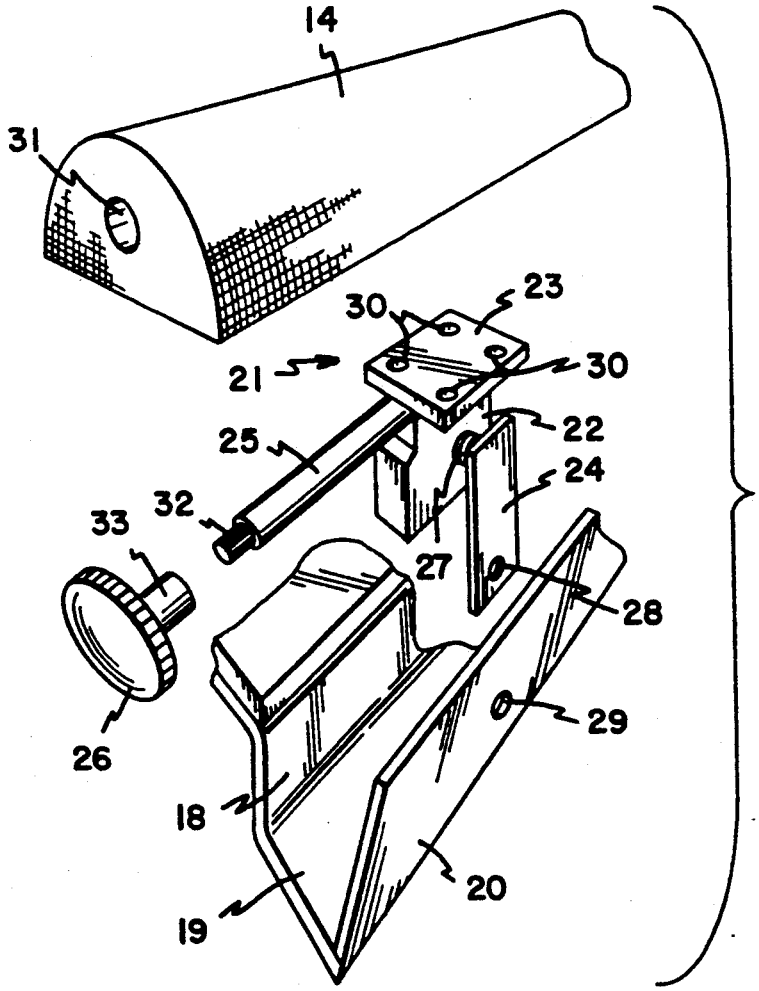
FIG. 3 shows a perspective view of the adjustment mechanism of the wrist support shown within FIG. 2.
Figure 4:
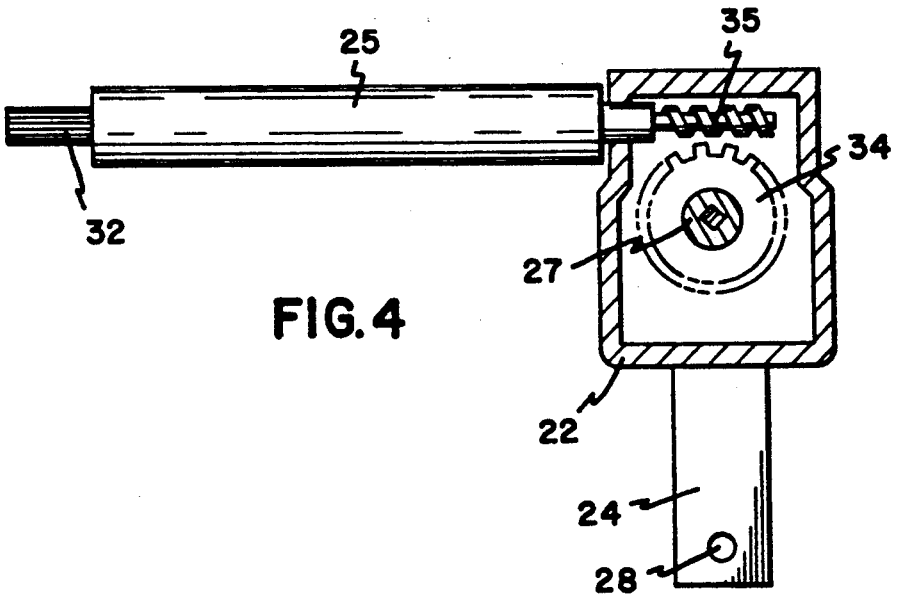
FIG. 4 shows a cross section of the mechanical operating parts of the adjustment mechanism shown within FIG. 3.
Figure 5:
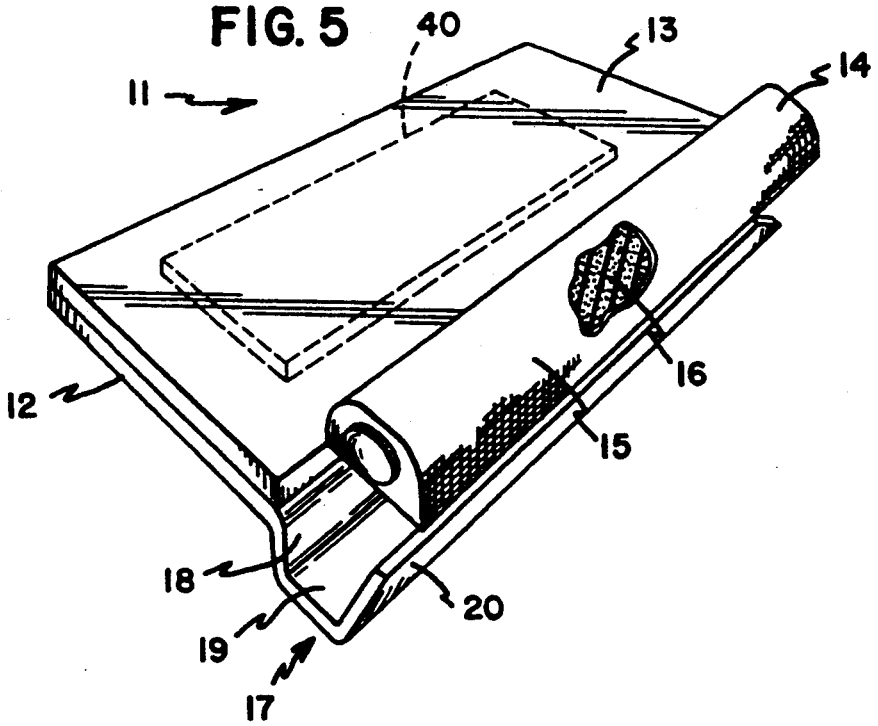
FIG. 5 shows a perspective view of the second embodiment shown in FIG. 2, with a weight shown in dashed lines.

A second embodiment of the invention is shown within FIGS. 2–4. The keyboard support 11 includes a baseplate 12 on which is mounted a non-skid foam pad 13 for supporting any type of keyboard. A wrist support portion 14 includes an outer fabric cover 15 and an inner foam core 16 similar to the wrist support 4 of FIG. 1. The wrist support is mounted upon a U-shaped overhang 17 which abuts the edge of a desktop when the support 11 is being used to support a computer keyboard. The overhang includes a first vertical leg 18 connected to the baseplate 12 and which abuts the edge of the desktop, when in use. The overhang further includes a horizontal leg 19 and a second substantially vertical leg 20 to which the wrist support portion 14 is connected. In order to compensate for the weight of the overhang, the baseplate includes a heavy steel weight 40 between the foam pad and baseplate. "FIG. 5 illustrates the positioning of weight 40 for the second embodiment." This weight prevents the support from tipping off of the desktop surface, in use.

FIG. 3 shows the adjustable nature of the wrist support 14 relative to the keyboard support. The adjustment mechanism 21 includes a body 22, a wrist support attachment flange 23, an overhang attachment link 24, and a rotatable shaft 25 extending outwardly from the body. A rotatable knob 26 is shown for rotating the shaft 25 which subsequently pivots the entire body 22 about an axle 27. The axle 27 is attached to one end of the line 24 while the other end of link 24 is attached to the overhang. The connection of the link to the overhang is achieved by a conventional fastener such as a rivet or screw through aligned holes 28 and 29 within the link 24 and leg 20, respectively. The connection allows the link to rotate relative to the overhang. The wrist support attachment flange includes four holes 30 at each corner. A suitable fastener such as a screw may be used to connect the adjustment mechanism to the underside of the wrist support 14. In the assembled state, the shaft 25 is disposed within an end bore 31 of the wrist support. A splined end 32 of shaft 25 is connected with a mated bore within projection 33 to hold the knob 26 upon the shaft 25.

In the fully assembled state, the adjustment mechanism 21 is connected to both the wrist support 14 and the overhang, and a similar adjustment mechanism that symmetrically mirrors the adjustment mechanism 21, shown, is connected at the opposite end of the wrist support 14, not shown. When the link 24 is vertical, as shown in FIG. 3., the wrist support is adjusted to its full extension above the keyboard support pad. To adjust the wrist support to an intermediate position, the knob 26 and the knob on the opposite adjustment mechanism are turned simultaneously. As the knobs are turned, they subsequently turn shafts 25 thereby turning axles 27. FIG. 4 shows details of the connection between shaft 25 and axle 27. A conventional gear is rigidly connected to shaft 27 and is rotatably disposed within housing 22. As the shaft 25 turns, an integral worm gear 35 at the end of shaft 25 turns the conventional gear 34 which mates with the worm gear. The mating of worm gear 35 and gear 34 allows the turning of shaft 25 to turn an orthogonally disposed axle 27.

As the shafts at both ends of the wrist support are turned, they cause the housings 22 to be moved downwardly and to the left, as viewed in FIG. 3. By turning both knobs simultaneously, the entire wrist support is moved down and due to the rigid connection of the housings 22 to the underside of the wrist support 14. The adjustment mechanism reaches its downward limit when the link 24 lies horizontally and parallel to the overhang. Thus, the overall range of adjustment is determined by the length of the link 24.

Both of the embodiments of the invention of FIGS. 1 and 2 share distinct advantages over prior art keyboard supports. Both supports use a padded cushion covered by a friction resistive fabric to provide greater comfort to the forearms of the operator. In prior art devices wrist supports have generally been made of smooth and hard materials. These hard materials can lead to the compression of the wrists onto the hard support causing pressure points to build on specific parts of the wrists and hands or may lead to the wrists moving around on the support causing skin irritation. In contrast the fabric covered pad of FIGS. 1 and 2 positions the wrists in a stationary position on the wrist support while the foam core nature of the support yields as the keyboard operator presses his/her wrists down on the keyboard. Additionally the rounded corners of the wrist support also assists in providing comfort to an operator's wrists. Another key aspect to both embodiments is the positioning of the forearms in a level and horizontal manner while using the keyboard. The level positioning of the wrists prevents the flexure of the wrists which can cause inflammation of the carpal tunnel sheath.

Both embodiments also use foam covered baseplates that hold the keyboard in place on the support. It is important in use that a keyboard remains stationary on the desktop, and the foam covered aspect of the keyboard support gives the keyboard a secure position while cushioning the keyboard from any hard shocks that may occur.

The embodiment of FIG. 1 uses a fixed height support to work with keyboards of similar height to achieve the level positioning of the wrists. Additionally, the lightweight nature of the FIG. 1 keyboard support makes it ideal as a portable computer accessory which can be carried by the operator to and from work or to other places of work. Furthermore, the support of FIG. 1 allows the operator to position the keyboard to his/her own preference. The positioning of the keyboard can include having the support set at an angle to the edge of the desktop or having the support set further inwardly on the desktop surface.

The embodiment of FIG. 2 uses a vertically adjustable wrist support that may be fine tuned to the operator's most comfortable typing position. The adjustability of this support allows the use of the support with a wide variety of keyboards. Additionally, this support includes an overhang that positions the support at the edge of the desktop. This overhang feature has advantages of minimizing the amount of desk space needed and brings the wrist support closer to the operator.

It should be apparent that many modifications could be made to the keyboard support which would still be encompassed within the spirit of the present invention. It is intended that all such modifications may fall within the scope of the appended claims.

What is claimed is:

1. A support for supporting a keyboard on an external surface, said external surface including an edge, said support further supporting a keyboard operator's hands over the keyboard so that a keyboard operator's wrists are supported in a generally nonflexed horizontal position, said support comprising:

a keyboard support portion including a top supporting surface for holding the keyboard in a stationary position relative to said support, said keyboard support portion including a bottom surface for resting on the external surface;

an overhang portion extending from said keyboard support portion along a front edge of said keyboard support portion, said overhang portion having a vertically descending member having an outer surface facing toward the keyboard operator, said outer surface defining a vertical depth extending vertically below said top supporting surface and said bottom surface of said keyboard support portion, said vertically descending member having an inner surface for abutting the edge of the external surface;

a wrist support portion connected to said overhang portion, said wrist support portion having a top surface, said top surface positionable at a height to support the keyboard operator's hands over the keyboard so that the keyboard operator's wrists are supported in a generally nonflexed horizontal position during typing; and means for adjusting said wrist support portion vertically along said vertical depth defined by said outer surface of said vertically descending member of said overhang portion wherein said wrist support portion is adjustable for keyboards of different vertical heights to permit support of the wrists in the generally nonflexed horizontal position during typing.

2. A support as claimed in claim 1, wherein said overhang portion further comprises:

a second substantially vertical member extending parallel to said vertically descending member; and a substantially horizontal member extending outwardly away from the external surface and connecting said vertically descending member to said second vertical member, said horizontal member disposed vertically lower than said bottom surface of said keyboard support portion.

3. A support as claimed in claim 1, wherein said means for adjusting includes:

connecting means for movably mounting said wrist support portion to said overhang portion, said connecting means including a rotatable handle assembly, said connecting means further including means for converting rotational movement of said handle assembly to vertical movement of said wrist support portion, wherein said connecting means permits the keyboard operator to manually move said wrist support portion relative to said overhang portion to vertically adjust said wrist support portion along said vertical depth defined by said vertically descending member.

4. A support as claimed in claim 1, wherein said wrist support portion includes a cushioning pad.

5. A support as claimed in claim 1, wherein said keyboard support portion includes a weight mounted to said keyboard support portion for counterbalancing the weight of said overhang portion, said wrist support portion, and the keyboard operator's hands and wrists supported by said wrist support portion, said counterweight preventing said keyboard support portion from tipping up off of the external surface while the operator exerts pressure upon said wrist support portion during typing.

6. A support for supporting a keyboard on an external surface, said external surface including an edge, said support further supporting a keyboard operator's hands over the keyboard so that a keyboard operator's wrists are supported in a generally nonflexed horizontal position, said support comprising:

a keyboard support portion including a foam pad having a top supporting surface for holding the keyboard in a stationary position relative to said support, said keyboard support portion including a base plate having a bottom surface for resting on the external surface, said foam pad mounted to said base plate and overlying said base plate;

an overhang portion extending from said keyboard support portion along a front edge of said keyboard support, said overhang portion extending horizontally outward beyond the edge of the external surface;

a wrist support portion connected to said overhang portion, said wrist support portion having a top surface, said top surface positioned at a height to support the keyboard operator's hands over the keyboard so that the keyboard operator's wrists are supported in a generally nonflexed horizontal position during typing; and a counterweight mounted to said keyboard support portion between said base plate and said foam pad, said counterweight in combination with said keyboard support portion sufficient to counterbalance the weight of said overhang portion, said wrist support portion, and at least some pressure applied by the operator to said wrist support portion during typing, to prevent said support from tipping up off of the external surface.

7. A support as claimed in claim 6, wherein said wrist support portion includes a cushioning pad.

8. A support as claimed in claim 6, further comprising means for adjusting said wrist support portion vertically relative to said overhang portion.

9. A support as claimed in claim 6, wherein said overhang portion has a vertically descending member defining a vertical depth extending vertically below said top supporting surface and said bottom surface of said keyboard support portion, said vertically descending member having an inner surface for abutting an edge of the external surface.

10. A support for supporting a keyboard operator's hands over a keyboard and further supporting the keyboard operator's wrists in a generally nonflexed horizontal position when the keyboard operator operates the keyboard, the keyboard being used in combination with a work station keyboard support for positioning the keyboard at a convenient height above the ground, the work station keyboard support having an external vertical surface facing toward the operator, said support comprising:

a support portion including a first substantially vertical member having an outer surface, said outer surface defining a vertical depth;

a wrist support portion connected to said support portion, said wrist support portion having a top surface, said top surface positionable at a height to allow the keyboard operator's hands to be positioned over the keys of the keyboard during typing so that the keyboard operator's wrists are supported in a generally nonflexed horizontal position;

means for adjusting said wrist support portion vertically wherein said wrist support portion moves adjacent to and along said outer surface of said first vertical member of said support portion; and means for positioning said support portion adjacent the keyboard wherein said first vertical member abuts the external vertical surface of the work station keyboard support and said outer surface faces the keyboard operator wherein said wrist support portion is adjustable relative to the work station keyboard support along said vertical depth to permit support of the operator's wrists in the generally nonflexed position during typing.

11. A wrist support as claimed in claim 10, wherein said support portion includes a second substantially vertical member extending parallel to said first vertical member and spaced apart from said first vertical member, and a third member connecting said first vertical member to said second vertical member, said wrist support portion mounted to said second vertical member, and said second vertical member being positioned between said first vertical member and the operator in the horizontal direction.

12. A support as claimed in claim 11, wherein said means for adjusting includes:

a linkage mounted to said second vertical member, said linkage further mounted to said wrist support portion to connect said wrist support portion to said support portion;

rotatable handle means for permitting the keyboard operator to move said wrist support portion and said linkage to vertically position said wrist support portion along said vertical depth defined by said first vertical member.

13. A support as claimed in claim 12, wherein said wrist support portion includes a cushioning pad disposed vertically beneath said top surface of said wrist support portion.

* * * * *